US005152519A

United States Patent [19]

Ifkovits, Jr.

[11] Patent Number: 5,152,519

[45] Date of Patent: Oct. 6, 1992

[54] PIVOTING SEPARATOR STONE FOR SINGULATING FEEDER

[75] Inventor: Edward M. Ifkovits, Jr., New Fairfield, Conn.

[73] Assignee: Pitney Bowes Inc., Stamford, Conn.

[21] Appl. No.: 824,869

[22] Filed: Jan. 24, 1992

[51] Int. Cl.[5] ..... B65H 3/06

[52] U.S. Cl. ..... 271/10; 271/35; 271/121; 271/151; 271/274

[58] Field of Search ..... 271/121, 124, 125, 273, 271/274, 10, 35, 151

[56] References Cited

U.S. PATENT DOCUMENTS 2,273,280 2/1942 Mayer .
2,273,288 2/1942 Rouan .
3,032,338 5/1962 Anderson et al. .
3,966,191 6/1976 Strobel ..... 271/125
4,232,860 11/1980 Brown .
4,666,140 5/1987 Godlewski .
4,715,593 12/1987 Godlewski .
4,772,004 9/1988 Golicz .
4,775,140 10/1988 Foster ..... 271/274 X
5,011,124 4/1991 Sardano et al. .
5,033,729 6/1981 Struthers .

*Primary Examiner*—Richard A. Schacher
*Attorney, Agent, or Firm*—Charles R. Malandra, Jr.; Melvin J. Scolnick

[57] ABSTRACT

Apparatus for singulating documents seriatim. The apparatus includes: a frame; a device for feeding documents from an upstream position to a downstream position; a separating roller rotatably mounted in the frame; a lower, take-away roller rotatably mounted in the frame situated downstream of the separating roller; and a pivotable housing pivotably mounted in the frame. The housing includes an upper, take-away roller situated above and adjacent the lower, take-away roller, and a separating stone situated above and adjacent the separating roller.

9 Claims, 5 Drawing Sheets

PIVOTING SEPARATOR STONE FOR SINGULATING FEEDER

BACKGROUND OF THE INVENTION

The instant invention relates to a singulating feeder for feeding sheets of paper seriatim from an upstream supply to downstream apparatus and further processing. More particularly, the invention relates to the separating stone used in such a feeder to effect singulation and apparatus which enables the stone to be pivoted away from the paper path and allow jam clearance adjacent the separator stone.

Mechanisms for the feeding of paper documents generally fall into two categories, those being vacuum fed and friction fed. The following description of the prior art will deal only with those types of feeders and material handlers which are considered to be friction-type feeders and which include singulators.

Friction feeders are preferred when it comes to feeding single paper documents. Friction feeders, as the name implies, rely on the interaction of several components that result in the singulation of paper documents. Two methods of singulation are provided by friction feeders. One style is via top feed and the second style is via bottom feed. A friction feeder is designed to operate as a top feed or a bottom feed, but it cannot operate in both modes. The components are usually a drive roller and a retarding device. The retarding device is of a material which provides a high coefficient of friction between the paper being fed and the drive roller.

In a bottom feed configuration, the paper begins as a vertical stack placed on a plurality of belts which usually are supported by a feeder table. This plurality of belts then advance the stack of paper toward a retarding device. As the plurality of belts advance the stack of paper under the retarding device, the friction between the belts and the bottom of the stack of paper tends to pull paper off the bottom of the stack. The retarding device provides the friction that acts to hold back the stack of paper. Therefore, the number of paper documents that are pulled from the bottom of the vertical stack is determined by the physical distance between the belts and the retarding device. If the distance is substantially the thickness of a single piece of paper, or the thickness of the material being singulated, a single paper will be delivered form the bottom of the stack. The single sheet delivery is generally the desired result. If the distance between the belts and the retarding device is the thickness of several pieces of paper or of the documents to be singulated, than a stream of paper documents will be delivered from the stack.

The typical retarding device in a bottom feed configuration is a stationary stone. If a jam should occur under the stone, the only means of clearing the jam is for the operation of the feeder to manually rotate the feeding rollers in order to back the jammed paper away from the stone. Such a task is tedious and time consuming. Because the gap between the feed rollers and the stone is only about 1/1000 inch, it is a very fine adjustment to re-set this gap, and thus all prior art separating stones are fixedly secured. The instant invention provides a pivoting separator stone which can be reliably separated from the paper path and replaced in its original position so that the gap between the stone and the roller is reliably re-set. Thus, an operator is enabled to move a singulating stone away from the path of the paper feed and facilitate quick jam clearance without the need for any feed rollers to be rotated or clearance gaps re-set.

SUMMARY OF THE INVENTION

Accordingly, the instant invention provides apparatus for singulating documents seriatim. The apparatus includes: a frame; means for feeding documents from an upstream position to a downstream position; a separating roller rotatably mounted in said frame; a lower, take-away roller rotatably mounted in said frame situated downstream of said separating roller; and a pivotable housing pivotably mounted in said frame. The housing includes an upper, take-away roller situated above and adjacent the lower, take-away roller, and separating stone situated above and adjacent the separating roller.

DETAILED DESCRIPTION OF THE PREFERRED EMBODIMENT

Figure 1:
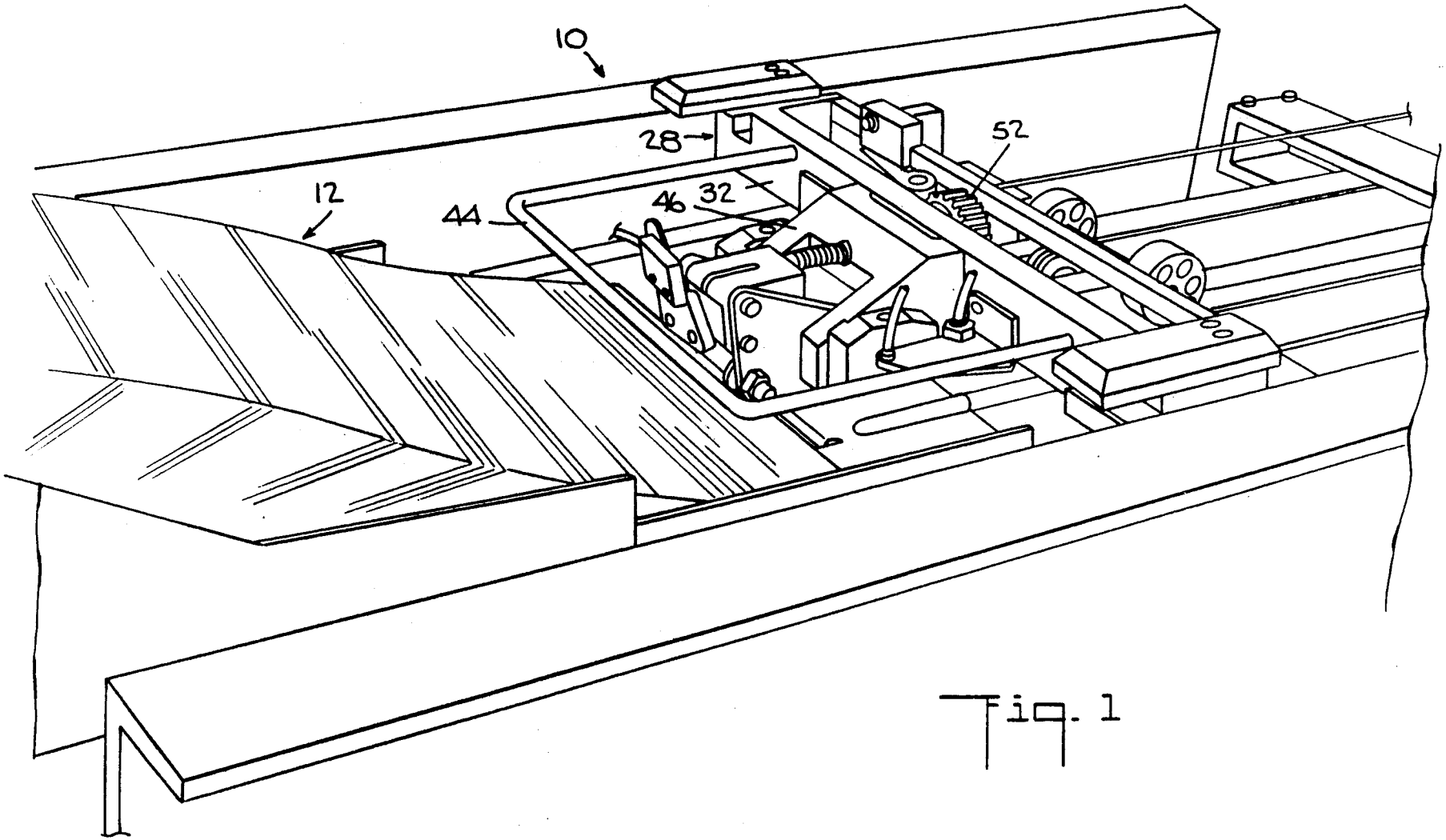
FIG. 1 is a perspective view of a separating device in a document feeder in accordance with the instant invention.
Figure 2:
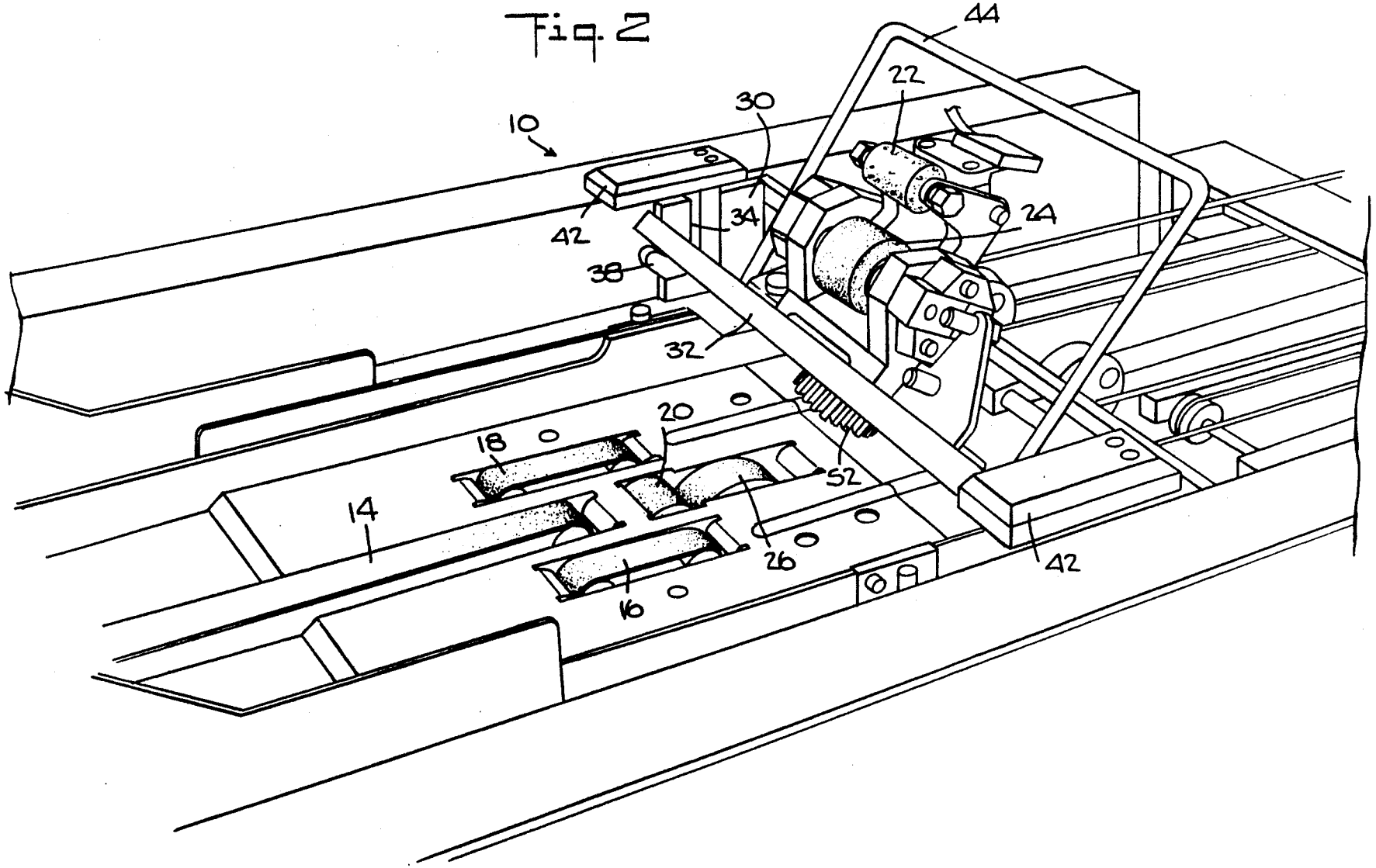
FIG. 2 is a perspective view of the apparatus seen in FIG. 1 but with the separating device shown pivoted away form the paper path to facilitate jam clearance.
Figure 3:
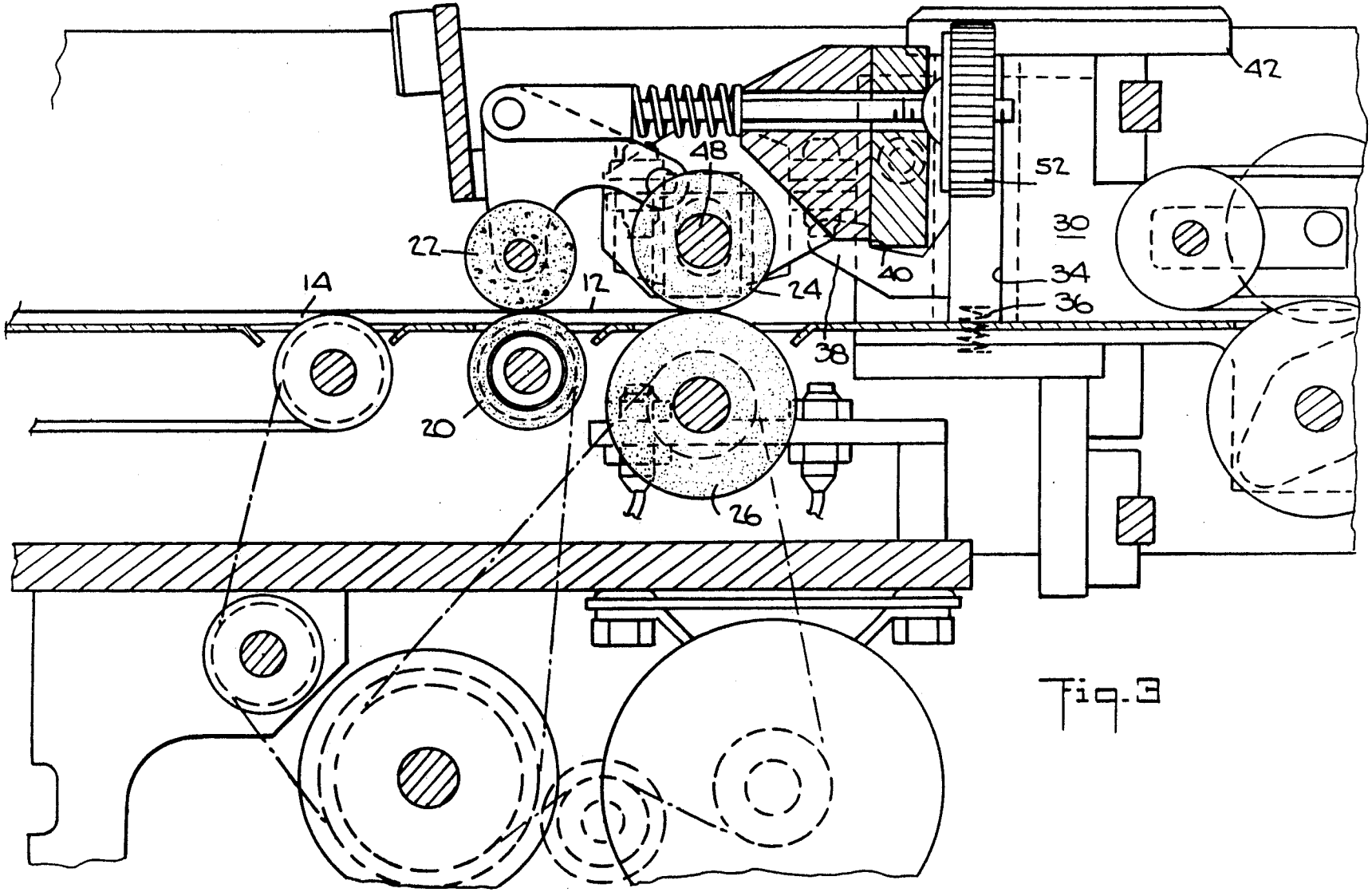
FIG. 3 is a vertical sectional view of the apparatus seen in FIG. 1.

In describing the preferred embodiment of the instant invention, reference is made to the drawings wherein there is seen a paper feeding module 10 for feeding and singulating a stream of paper sheets 12 from an upstream position to a downstream position where they will be further processed and ultimately inserted into an envelope. An intermittently driven belt 14 (see FIG. 2) feeds the sheets 12 toward a pair of intermittently driven belts 16 and 18. At the downstream end of the belts 16 and 18 are a separating roller 20 and a separating stone 22 located above the roller 20 (see FIG. 3). The separating roller 20 is intermittently driven in the same manner as the belts 14, 16 and 18.

Downstream of the separator stone 22 are a pair of continuously running take-way rollers 24 and 16 for conveying the sheets of paper 12 downstream in simulated fashion seriatim. The upper take-away roller 24 and the separator stone 22 are mounted in a pivotable housing generally designated 28.

The housing 28 includes a pair of sideframes 30. A pivotable bar 32 is pivotably mounted at its end in the tow sideframes 30. Each of the sideframes 30 includes a slot 34 for housing a spring 36 and for slidably receiving a locking cam 38 which has a locking surface 40 and a flange 42 to facilitate unlocking, both of which will be discussed in further detail hereinbelow.

The pivotable bar 32 includes a handle 44 and a supporting structure 46 which provides journals for s shaft 48 on which is rotatably mounted the take-away roller 24. A pair of springs 50 are seated in the supporting structure 46 and provide a downward bias on the shaft 48 so that the upper, take-away roller 24 is biased downwardly towards the lower, take-away roller 26.

Also housed in the supporting structure 46 but more remote from the pivoting bar 32 than the take-away roller 24 is the separator stone 22. The gap between the separator stone 22 and the separating roller 20 is set by means of a rotatable wheel 52.

Figure 4:
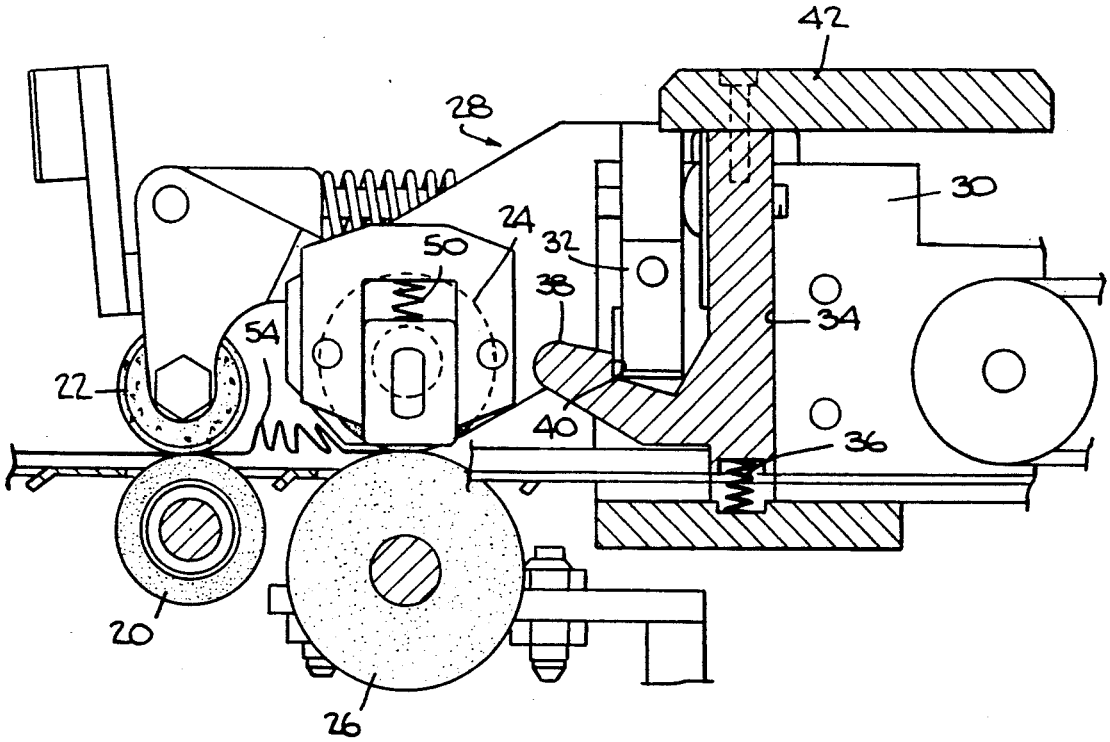
FIG. 4 is a vertical, sectional view of the separating device and shows a paper jam.
Figure 5:
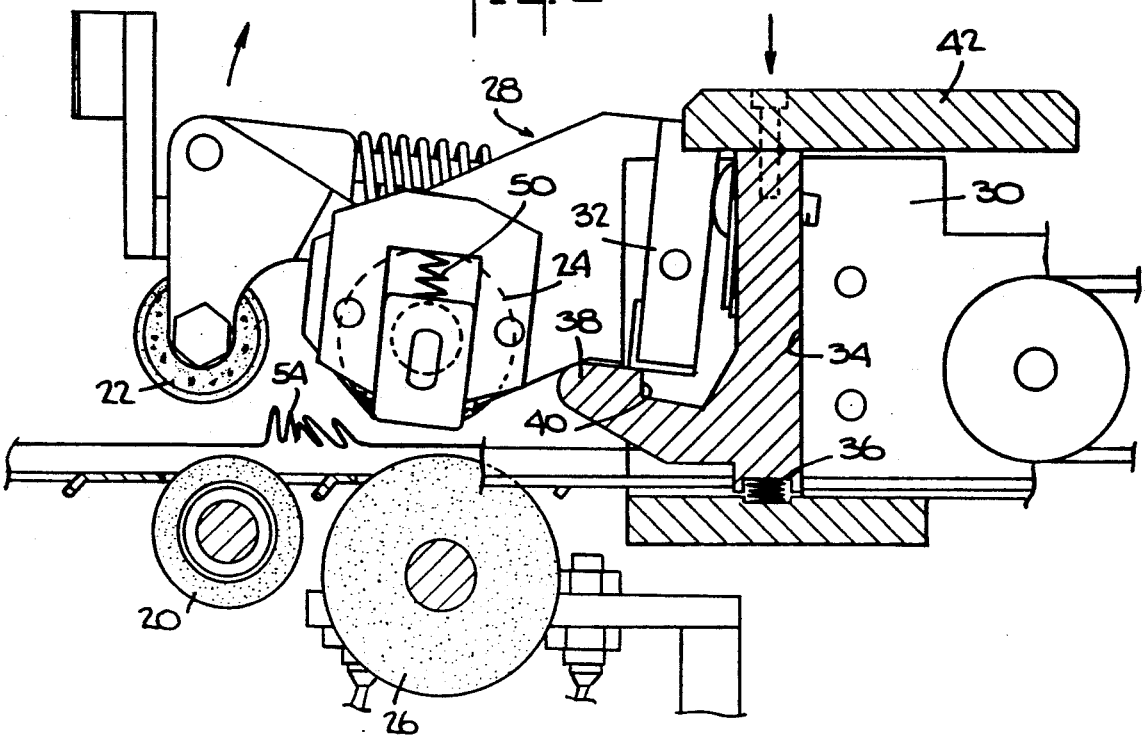
FIG. 5 is similar to FIG. 4 but shows the separating device staring to be pivoted away from the paper path.
Figure 6:
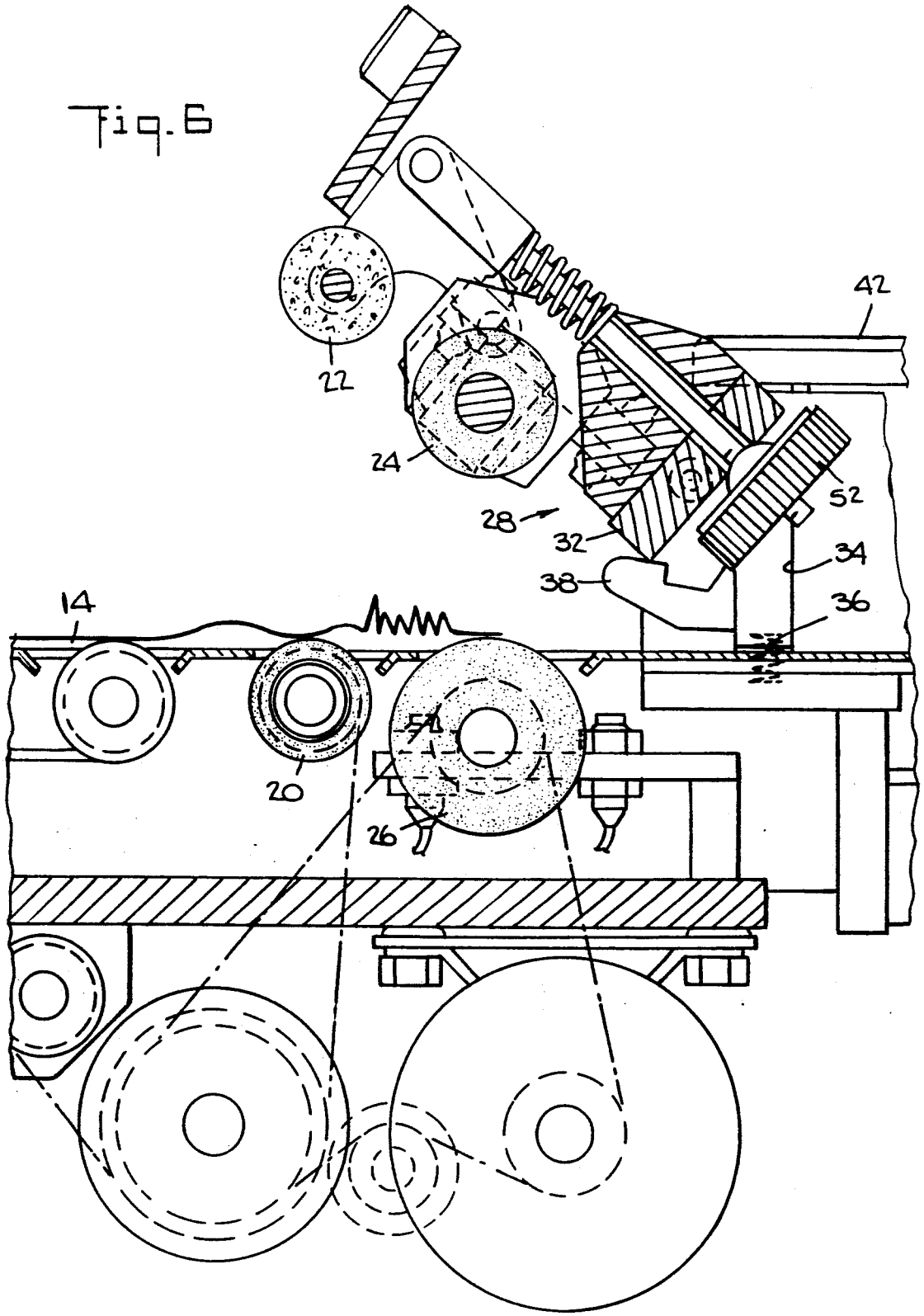
FIG. 6 is similar to FIG. 5 but shows the separating device completely moved away from the paper path to allow removal of the jammed paper.

When a sheet of paper becomes jammed, as sheet 54 is in FIG. 4, the operator simply presses down on the two flanges 42, which, as seen in FIG. 5, overcomes the bias of the springs 36 and moves the locking surface 40 down and away from bar 32, which allows the bar 32 to swing clockwise from the position sen in FIG. 4 to the position seen in FIG. 5. The operator can then grab the handle 44 and swing the pivoting housing 28 clockwise to the position seen in FIG. 6, which provides complete access to remove the jammed paper 54.

To re-set the housing 28 so that the gap between the stone 22 and the roller 20 is accurately re-set, the operator simply grabs the handle 44 and rotates it counterclockwise until the bar 32 moves past the cam locking surface 40 at which point the springs 36 urge the locking cam 38 upward to the position seen in FIG. 4. The pivoting bar 32 is urged against the locking surface 40 by the force exerted by the springs 350 against the upper, take-away roller 24 which have the effect of creating a clockwise bias on the housing 28 and specifically the bottom of the bar 32 below the pivot points. Because of the foregoing action and forces generated from the upper, take-way roller 24, the gap between the stone 22 and the separating roller 20 can be accurately and reliably re-set each time a jam has to be cleared.

It is thought that the foregoing invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. Apparatus for singulating documents seriatim, comprising:

a frame;

means for feeding documents from an upstream position to a downstream position;

a separating roller rotatably mounted in said frame;

a lower, take-away roller rotatably mounted in said frame situated downstream of said separating roller; and a pivotable housing pivotably mounted in said frame, said housing having an upper, take-away roller situated above and adjacent said lower, take-away roller, and a separating stone situated above and adjacent said separating roller.

2. The apparatus of claim 1, additionally including means for biasing said upper, take-away roller toward said lower, take-away roller.

3. The apparatus of claim 2 wherein said pivotable housing includes a pair of sideframes, and said apparatus additionally comprises a pivotable bar mounted at its ends in said sideframes.

4. The apparatus of claim 3, wherein each of said sideframes includes a vertically extending slot and a spring mounted in said slot.

5. The apparatus of claim 4, additionally comprising a locking cam slidably mounted in said vertically extending slots.

6. The apparatus of claim 5, wherein said locking cam includes a locking surface for engagement with said pivotable bar.

7. The apparatus of claim 6, wherein said locking cam additionally includes a flange to facilitate locking and unlocking of said pivotable housing.

8. The apparatus of claim 7, wherein said pivotable bar includes a handle.

9. The apparatus of claim 7, wherein said pivotable bar includes a supporting structure for supporting said upper, take-away roller and said separating stone.

* * * * *

UNITED STATES PATENT AND TRADEMARK OFFICE

CERTIFICATE OF CORRECTION

PATENT NO. : 5,152,519

DATED : October 6, 1992

INVENTOR(S) : Edward M. Ifkovits, Jr.

It is certified that error appears in the above-identified patent and that said Letters Patent is hereby corrected as shown below:

On the cover page of patent, correct serial number should be --824,969--, not "824,869".

Column 1, line 48, change "form" to --from--;

Column 1, line 57, change "operation" to --operator--.

Column 2, line 14, after "and" (second occurrence), insert --a--;
Column 2, line 25, change "form" to --from--;
Column 2, line 26, after "vertical" insert --,--;
Column 2, line 31, change "staring" to --starting--;
Column 2, lines 54 and 55, change "simulated" to --singulated--;
Column 2, line 59, change "tow" to --two--;
Column 2, line 65, change "s" to --a--.

Column 3, line 14, change "sen" to --seen--;
Column 3, line 27, change "350" to --50--;

Column 4, line 39, change "claim 7," to --claim 8,--.

Signed and Sealed this

Fifteenth Day of March, 1994

Bruce Lehman

*Attest:*

BRUCE LEHMAN

*Attesting Officer*

*Commissioner of Patents and Trademarks*